US007445428B2

(12) United States Patent
Baar

(10) Patent No.: US 7,445,428 B2
(45) Date of Patent: Nov. 4, 2008

(54) EXHAUST-GAS TURBOCHARGER FOR AN INTERNAL COMBUSTION ENGINE WITH A VARIABLE TURBINE GEOMETRY

(75) Inventor: Roland Baar, Gifhorn (DE)

(73) Assignee: Volkswagen AG, Wolfsburg (DE)

( * ) Notice: Subject to any disclaimer, the term of this patent is extended or adjusted under 35 U.S.C. 154(b) by 672 days.

(21) Appl. No.: 11/159,663

(22) Filed: Jun. 23, 2005

(65) Prior Publication Data

US 2005/0286999 A1 Dec. 29, 2005

(30) Foreign Application Priority Data

Jun. 25, 2004 (DE) ..... 10 2004 030 798

(51) Int. Cl.
*F01D 17/16* (2006.01)

(52) U.S. Cl. ..... 415/164; 415/165; 415/177

(58) Field of Classification Search ..... 415/163, 415/164, 165, 161, 177, 206; 417/407
See application file for complete search history.

(56) References Cited

U.S. PATENT DOCUMENTS 4,770,603 A * 9/1988 Engels et al. ..... 415/147
4,804,316 A 2/1989 Fleury
5,454,225 A * 10/1995 Sumser et al. ..... 60/602
6,256,991 B1 * 7/2001 Schmidt et al. ..... 60/602
6,314,736 B1 11/2001 Daudel et al.
6,371,722 B1 4/2002 Takahashi

FOREIGN PATENT DOCUMENTS

DE 100 11 441 C2 9/2000
DE 199 61 613 A1 7/2001
JP 61268804 11/1986

* cited by examiner

*Primary Examiner*—Ninh H Nguyen

(57) ABSTRACT

An exhaust-gas turbocharger for an internal combustion engine, in particular of a motor vehicle, includes a turbine housing, a bearing housing, a guide vane carrier, a flow passage component which forms a portion of a flow passage in a turbine of the exhaust-gas turbocharger, and guide vanes, which are disposed on the guide vane carrier such that they can pivot in an annular passage formed between the flow passage component and the guide vane carrier. At least one securing bolt secures the guide vane carrier to the bearing housing. The securing bolt extends through the guide vane carrier and into the bearing housing in a plane parallel to the annular passage.

6 Claims, 1 Drawing Sheet

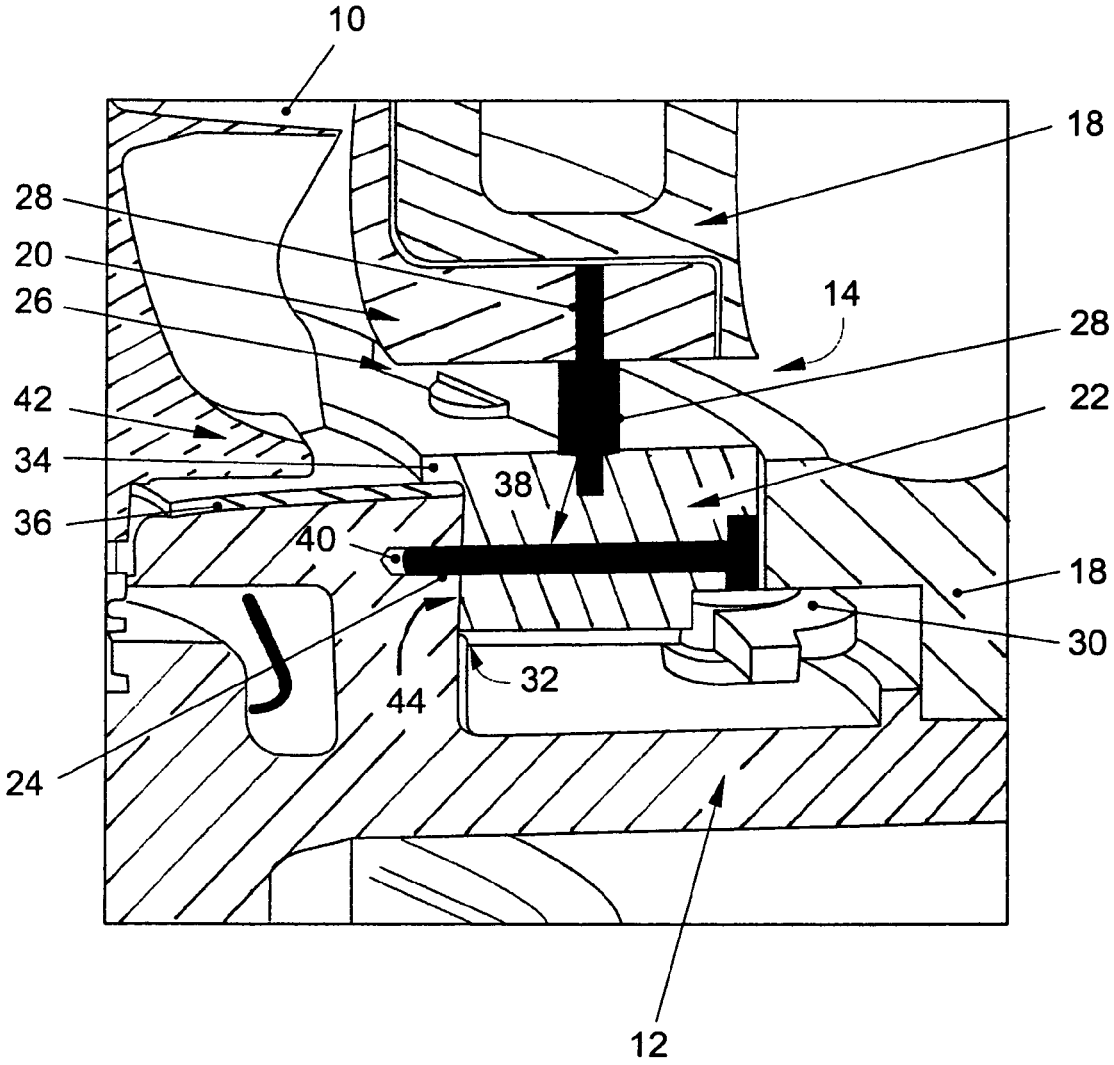
10
18
28
20
26
14
28
42
22
34
38
36
40
18
30
32
44
24
12

EXHAUST-GAS TURBOCHARGER FOR AN INTERNAL COMBUSTION ENGINE WITH A VARIABLE TURBINE GEOMETRY

BACKGROUND OF THE INVENTION

Field of the Invention

The invention relates to an exhaust-gas turbocharger for an internal combustion engine, in particular of a motor vehicle, having a turbine housing, a bearing housing, a guide vane carrier, a flow passage component, which forms a portion of a flow passage in a turbine of the exhaust-gas turbocharger, and guide vanes, which are disposed on the guide vane carrier such that they can pivot in an annular passage formed between the flow passage component and the guide vane carrier.

German Patent No. DE 100 11 441 C2 (corresponding to U.S. Pat. No. 6,371,722 B1) discloses an exhaust-gas turbocharger in which a separate flow passage component, which is also referred to as a trumpet or contoured sleeve, forms a flow passage with an annular turbine shell in the turbine housing.

Japanese Patent No. JP 61-268804 discloses an exhaust turbine of an exhaust-gas turbocharger with a variable turbine geometry, in which, to avoid vibrations in the guide vanes, the latter are disposed radially offset or spaced apart with respect to guide vane pivot axes. The guide vanes are supported by a guide vane carrier which is bolted to a bearing housing. A flow passage for exhaust gas in the exhaust-gas turbine is completely formed by the turbine housing. This requires a high level of accuracy when producing the turbine housing, so that free ends of the guide vanes on the one hand bear closely enough against a wall of the turbine housing to provide a suitable seal, but on the other hand do not bear too strongly against the turbine housing, since otherwise there is a risk of an adjustment mechanism for the guide vanes becoming blocked. This problem is further exacerbated by thermal expansion in the turbine housing and the guide vane carrier.

To alleviate the problem of thermal expansion, with the risk of jamming between guide vanes and the turbine housing, U.S. Pat. No. 4,804,316 teaches that the guide vane carrier be bolted to that part of the turbine housing which, together with the guide vane carrier, forms an annular passage for the guide vanes by using a bolt which engages through a spacer sleeve.

German Non-Prosecuted Published Patent Application No. DE 199 61 613 A1 (corresponding to U.S. Pat. No. 6,314,736) discloses an exhaust-gas turbine of an exhaust-gas turbocharger for an internal combustion engine with a variable turbine geometry, wherein guide vanes are provided with a pin bearing on a side remote from an adjustment device. This is intended to create a double-sided guide vane bearing configuration, which is supposed to result in increased stability and reduced vibrations at the guide vanes.

SUMMARY OF THE INVENTION

It is accordingly an object of the invention to provide an exhaust gas turbocharger which overcomes the above-mentioned disadvantages of the heretofore-known exhaust gas turbochargers of this general type and whose structure and assembly is simplified while at the same time the turbocharger has an improved functionality with respect to gas tightness at critical locations.

With the foregoing and other objects in view there is provided, in accordance with the invention, an exhaust-gas turbocharger, including:

a turbine including a turbine housing, the turbine having a flow passage formed therein;

a flow passage component forming a portion of the flow passage in the turbine;

a bearing housing;

a guide vane carrier secured to the bearing housing;

the flow passage component and the guide vane carrier forming an annular passage between the flow passage component and the guide vane carrier, the annular passage defining an annular passage plane;

guide vanes pivotably disposed on the guide vane carrier such that the guide vanes are pivotable in the annular passage formed between the flow passage component and the guide vane carrier; and a securing bolt for securing the guide vane carrier to the bearing housing, the securing bolt extending through the guide vane carrier and into the bearing housing in a plane parallel to the annular passage plane.

In other words, according to the invention, there is provided an exhaust-gas turbocharger for an internal combustion engine, in particular of a motor vehicle, having a turbine housing, a bearing housing, a guide vane carrier, a flow passage component which forms a portion of a flow passage in a turbine of the exhaust-gas turbocharger, and guide vanes, which are disposed on the guide vane carrier such that they can pivot in an annular passage formed between the flow passage component and the guide vane carrier, wherein there is at least one securing bolt for securing the guide vane carrier to the bearing housing, which securing bolt engages through the guide vane carrier and into the bearing housing in a plane parallel to the annular passage.

This has the advantage that a guide vane adjustment module, which includes the guide vanes, the guide vane carrier, the spacer bolts for the annular passage, the flow passage component and the adjustment unit with a guide vane lever and an adjustment ring, can be mounted on the bearing housing as a fully preassembled module.

In a preferred embodiment, an axial stop for the guide vane carrier is formed on the bearing housing, the axial stop determining an axial mounting position of the guide vane carrier.

For an accurate fixing or positioning of the guide vane carrier in the mounting position through the use of the securing bolts, for each securing bolt, a through-bore is formed in the guide vane carrier and a blind hole is formed in the bearing housing, and these are located and formed in such a manner that in each case one through-bore in the guide vane carrier is aligned with a blind hole in the bearing housing when the guide vane carrier is in the mounting position with respect to the bearing housing.

The fact that the guide vane carrier, at its radially inner surface, has an encircling projection, and that an axially resilient metal heat shield plate is provided, one axial end of which is supported against the radial projection on the guide vane carrier, and the opposite axial end of which is supported against the bearing housing, the resilient metal heat shield plate being configured in such a manner that, in the mounting position of the guide vane carrier, it applies a force to the latter away from the axial stop toward the annular passage, means that the at least one securing bolt, in the mounting position, is clamped by the spring force of the metal heat shield plate, so that the mounting position is automatically maintained without further measures.

According to another feature of the invention, an axial stop for the guide vane carrier is provided, the axial stop being formed on the bearing housing, and the axial stop determining an axial mounting position for the guide vane carrier.

According to yet another feature of the invention, the guide vane carrier has a through-bore formed therein; the bearing housing has a blind hole formed therein; and the through-bore is aligned with the blind hole when the guide vane carrier is in a mounting position with respect to the bearing housing According to a further feature of the invention, a metal heat shield plate is provided; the guide vane carrier has a radial inner surface and has an encircling projection provided at the radial inner surface; the bearing housing and the guide vane carrier define an axial direction, the metal heat shield plate has a first axial end and a second axial end disposed opposite the first axial end; the first axial end of the metal heat shield plate is supported against the encircling projection on the radial inner surface of the guide vane carrier; the second axial end of the metal heat shield plate is supported against the bearing housing; and the metal heat shield plate is resilient in the axial direction such that, when the guide vane carrier is in a mounting position, the metal heat shield plate applies a force to the guide vane carrier away from the axial stop and toward the annular passage.

Other features which are considered as characteristic for the invention are set forth in the appended claims.

Although the invention is illustrated and described herein as embodied in an exhaust-gas turbocharger for an internal combustion engine with a variable turbine geometry, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWINGS

The single FIGURE is a partial sectional perspective view of a preferred embodiment of an exhaust-gas turbocharger according to the invention.

DESCRIPTION OF THE PREFERRED EMBODIMENTS

Referring now to the single FIGURE, there is shown a preferred embodiment of an exhaust-gas turbocharger according to the invention for an internal combustion engine. The exhaust gas turbocharger includes a bearing housing 12, in which exhaust gas flows radially via an annular passage 14 to a turbine wheel 42 and drives the latter. For its part, the turbine wheel 42, via a shaft, drives a compressor impeller of the exhaust-gas turbocharger. An axial flow passage 10 for exhaust gas is formed within a turbine housing 18 by a flow passage component 20, which is also referred to as a trumpet, contoured sleeve or cartridge. In addition, the annular passage 14 is formed by the flow passage component 20 and a guide vane carrier 22, at least one spacer sleeve 28 being fitted so as to fix a suitable distance between the flow passage component 20 and the guide vane carrier 22. Guide vanes 26 held on the guide vane carrier 22 are disposed in the annular passage 14. These are configured to be pivotable in the usual way, in order to set a turbine power according to a current operating state of the internal combustion engine. To adjust the guide vanes 26 there is an adjustment ring 30, which is connected to all the respective adjustment levers of the guide vanes 26.

On its inner circumference, the guide vane carrier 22 has an encircling projection 34. Furthermore, an axially resilient metal heat shield plate 36 is provided, one axial end of which is supported against the radial projection on the guide vane carrier, and the opposite axial end of which is supported against the bearing housing. The axially resilient metal heat shield plate 36 is configured in such a manner that, in the mounting position of the guide vane carrier 22 relative to the bearing housing 12, as illustrated in the single FIGURE, it exerts a force on the guide vane carrier 22 in the direction of the annular passage 14 or away from the bearing housing 12, i.e. substantially perpendicular to a plane defined by the annular passage 14. An axial stop 32, which defines a mounting position of the guide vane carrier 22 with respect to the bearing housing 12 in the axial direction, is formed on the bearing housing 12. A stop face 44 which runs all the way around in the circumferential direction guides the guide vane carrier 22 in the radial direction and accordingly defines a mounting position of the guide vane carrier 22 with respect to the bearing housing 12 in the radial direction.

According to the invention, the guide vane carrier 22 is pinned to the bearing housing 12. For this purpose, there is at least one securing bolt 24, which engages through a respective through-bore 38 in the guide vane carrier 22 and into a respective blind hole 40 in the bearing housing 12. The through-bore 38 in the guide vane carrier 22 and the blind hole 40 in the bearing housing 12 are configured and formed in such a manner that in each case one through-bore 38 in the guide vane carrier 22 is aligned with a blind hole 40 in the bearing housing 12 when the guide vane carrier 22 bears against the axial stop 32 of the bearing housing 12, with radial guidance by the surface 44 of the bearing housing 12. In this position, the at least one securing bolt 24 is introduced into the through-hole 38 in the guide vane carrier 22 and into the blind hole 40 in the bearing housing 12, so that the guide vane carrier 22 is pinned to the bearing housing 12.

On account of the axially resilient metal heat shield plate 36, the guide vane carrier 22, during mounting on the bearing housing 12, has to be pushed axially onto the stop 32 counter to the spring force of the metal heat shield plate 36. This is carried out, for example, through the use of a mounting apparatus which applies the force required to overcome the spring force of the metal heat shield plate 36. After all the securing bolts 24 have been inserted into the through-bores 38 and blind holes 40, the mounting apparatus is released, so that the metal heat shield plate 36 applies force to the guide vane carrier 22. As a result, the securing bolts 24 are clamped in position, since the spring force of the metal heat shield plate 36 acts on the guide vane carrier 22 perpendicular to the orientation of the securing bolts 24, so that the latter are fixed without the need for further measures. After the turbine housing 18 has been mounted, the securing bolts 24 are additionally held captively, as will immediately become clear from the single FIGURE.

The securing of the guide vane carrier 22 to the bearing housing 12 in accordance with the invention allows a guide vane adjustment module, which includes the guide vanes 26, the guide vane carrier 22, the spacer bolts 28 for the annular passage 14, the flow passage component 20 and the adjustment unit with a guide vane lever and the adjustment ring 30, to be mounted on the bearing housing 12 as a fully preassembled module. A guide vane adjustment module of this type per se, in addition to the abovementioned mounting advantages, also avoids jamming of guide vanes and minimizes the gap between turbine wheel 42 or guide vanes 26 and the opposite side of the turbine housing.

This application claims the priority, under 35 U.S.C. § 119, of German patent application No. 10 2004 030 798.0, filed Jun. 25, 2004; the entire disclosure of the prior application is herewith incorporated by reference.

I claim:

1. An exhaust-gas turbocharger, comprising:

a turbine including a turbine housing, said turbine having a flow passage formed therein;

a flow passage component forming a portion of said flow passage in said turbine;

a bearing housing;

a guide vane carrier secured to said bearing housing;

said flow passage component and said guide vane carrier forming an annular passage between said flow passage component and said guide vane carrier, said annular passage defining an annular passage plane;

guide vanes pivotably disposed on said guide vane carrier such that said guide vanes are pivotable in said annular passage formed between said flow passage component and said guide vane carrier; and a securing bolt for securing said guide vane carrier to said bearing housing, said securing bolt extending through said guide vane carrier and into said bearing housing in a plane parallel to the annular passage plane.

2. The exhaust-gas turbocharger according to claim 1, including an axial stop for said guide vane carrier, said axial stop being formed on said bearing housing, and said axial stop determining an axial mounting position for said guide vane carrier.

3. The exhaust-gas turbocharger according to claim 2, wherein:

said guide vane carrier has a through-bore formed therein;

said bearing housing has a blind hole formed therein; and said through-bore is aligned with said blind hole when said guide vane carrier is in a mounting position with respect to said bearing housing.

4. The exhaust-gas turbocharger according to claim 2, including:

a metal heat shield plate;

said guide vane carrier having a radial inner surface and having an encircling projection provided at said radial inner surface;

said bearing housing and said guide vane carrier defining an axial direction, said metal heat shield plate having a first axial end and a second axial end disposed opposite said first axial end;

said first axial end of said metal heat shield plate being supported against said encircling projection on said radial inner surface of said guide vane carrier;

said second axial end of said metal heat shield plate being supported against said bearing housing; and said metal heat shield plate being resilient in the axial direction such that, when said guide vane carrier is in a mounting position, said metal heat shield plate applies a force to said guide vane carrier away from said axial stop and toward said annular passage.

5. In combination with an internal combustion engine, an exhaust-gas turbocharger, comprising:

a turbine including a turbine housing, said turbine having a flow passage formed therein;

a flow passage component forming a portion of said flow passage in said turbine;

a bearing housing;

a guide vane carrier secured to said bearing housing;

said flow passage component and said guide vane carrier forming an annular passage between said flow passage component and said guide vane carrier, said annular passage defining an annular passage plane;

guide vanes pivotably disposed on said guide vane carrier such that said guide vanes are pivotable in said annular passage formed between said flow passage component and said guide vane carrier; and a securing bolt for securing said guide vane carrier to said bearing housing, said securing bolt extending through said guide vane carrier and into said bearing housing in a plane parallel to the annular passage plane.

6. In a motor vehicle having an internal combustion engine, an exhaust-gas turbocharger, comprising a turbine including a turbine housing, said turbine having a flow passage formed therein;

a flow passage component forming a portion of said flow passage in said turbine;

a bearing housing;

a guide vane carrier secured to said bearing housing;

said flow passage component and said guide vane carrier forming an annular passage between said flow passage component and said guide vane carrier, said annular passage defining an annular passage plane;

guide vanes pivotably disposed on said guide vane carrier such that said guide vanes are pivotable in said annular passage formed between said flow passage component and said guide vane carrier; and a securing bolt for securing said guide vane carrier to said bearing housing, said securing bolt extending through said guide vane carrier and into said bearing housing in a plane parallel to the annular passage plane.

* * * * *